US010424831B2

(12) United States Patent
Hsu et al.

(10) Patent No.: US 10,424,831 B2
(45) Date of Patent: Sep. 24, 2019

(54) ANTENNA SYSTEM

(71) Applicant: Wistron NeWeb Corp., Hsinchu (TW)

(72) Inventors: Chieh-Sheng Hsu, Hsinchu (TW); Cheng-Geng Jan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 63 days.

(21) Appl. No.: 15/803,602

(22) Filed: Nov. 3, 2017

(65) Prior Publication Data

US 2019/0027814 A1 Jan. 24, 2019

(30) Foreign Application Priority Data

Jul. 20, 2017 (TW) ..... 106124313 A

(51) Int. Cl.

| | |
|---|---|
| ***H01Q 21/26*** | (2006.01) |
| ***H01Q 1/24*** | (2006.01) |
| ***H01Q 19/10*** | (2006.01) |
| ***H01Q 9/28*** | (2006.01) |
| ***H01Q 15/23*** | (2006.01) |
| ***H01Q 19/22*** | (2006.01) |
| ***H01Q 25/00*** | (2006.01) |
| *H01Q 9/04* | (2006.01) |

(52) U.S. Cl.

CPC ..... *H01Q 1/246* (2013.01); *H01Q 9/285* (2013.01); *H01Q 15/23* (2013.01); *H01Q 19/108* (2013.01); *H01Q 19/22* (2013.01); *H01Q 21/26* (2013.01); *H01Q 25/001* (2013.01); *H01Q 9/0414* (2013.01)

(58) Field of Classification Search

CPC ..... H01Q 19/108; H01Q 19/10; H01Q 1/24; H01Q 1/246; H01Q 21/26; H01Q 9/28; H01Q 9/285

See application file for complete search history.

(56) References Cited

U.S. PATENT DOCUMENTS

| | | | | |
|---|---|---|---|---|
| 5,940,044 A * | 8/1999 | Smith | ..... | H01Q 1/246 343/794 |
| 6,067,053 A * | 5/2000 | Runyon | ..... | H01Q 1/246 343/700 MS |
| 7,639,198 B2 * | 12/2009 | Timofeev | ..... | H01Q 1/246 343/795 |

(Continued)

FOREIGN PATENT DOCUMENTS

| | | |
|---|---|---|
| CN | 203312457 U | 11/2013 |
| TW | I563730 B | 12/2016 |

*Primary Examiner* — Tho G Phan

(57) ABSTRACT

An antenna system includes a dual-polarized antenna, a metal reflection plate, a first metal bending structure, and a second metal bending structure. The metal reflection plate is configured to reflect the radiation energy from the dual-polarized antenna. The first metal bending structure includes a first planar portion and a second planar portion. The second planar portion is coupled through the first planar portion to a first edge of the metal reflection plate. The first planar portion and the second planar portion are not parallel to each other. The second metal bending structure includes a third planar portion and a fourth planar portion. The fourth planar portion is coupled through the third planar portion to a second edge of the metal reflection plate. The third planar portion and the fourth planar portion are not parallel to each other.

18 Claims, 12 Drawing Sheets

(56) References Cited

U.S. PATENT DOCUMENTS

| | | | | |
|---|---|---|---|---|
| 7,804,460 | B2 * | 9/2010 | Lee | H01Q 9/26 343/797 |
| 10,056,701 | B2 * | 8/2018 | Petropoulos | H01Q 5/50 |
| 2010/0127939 | A1 * | 5/2010 | Yusa | H01Q 9/0407 343/700 MS |
| 2011/0175782 | A1 * | 7/2011 | Choi | H01Q 1/246 343/798 |
| 2017/0085289 | A1 * | 3/2017 | Jan | H04B 7/0617 |

* cited by examiner

470

ANTENNA SYSTEM

CROSS REFERENCE TO RELATED APPLICATIONS

This Application claims priority of Taiwan Patent Application No. 106124313 filed on Jul. 20, 2017, the entirety of which is incorporated by reference herein.

BACKGROUND OF THE INVENTION

Field of the Invention

The disclosure generally relates to an antenna system, and more particularly, to an antenna system for equalizing the beam width of each antenna.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the internet at high speeds. However, since indoor environments exhibit serious signal reflection and multipath fading, wireless access points should process signals in a variety of polarization directions and from a variety of transmission directions simultaneously. Accordingly, it has become a critical challenge for antenna designers to design a multi-polarized antenna with an equalized beam width in the limited space of a wireless access point.

BRIEF SUMMARY OF THE INVENTION

In an exemplary embodiment, the disclosure is directed to an antenna system including a first dual-polarized antenna, a metal reflection plate, a first metal bending structure, and a second metal bending structure. The first dual-polarized antenna includes a first diamond-shaped dipole antenna element and a second diamond-shaped dipole antenna element. The metal reflection plate has a first edge and a second edge which are opposite to each other. The metal reflection plate is configured to reflect the radiation energy from the first dual-polarized antenna. The first metal bending structure includes a first planar portion and a second planar portion. The second planar portion is coupled through the first planar portion to the first edge of the metal reflection plate. The first planar portion and the second planar portion are not parallel to each other. The second metal bending structure includes a third planar portion and a fourth planar portion. The fourth planar portion is coupled through the third planar portion to the second edge of the metal reflection plate. The third planar portion and the fourth planar portion are not parallel to each other.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
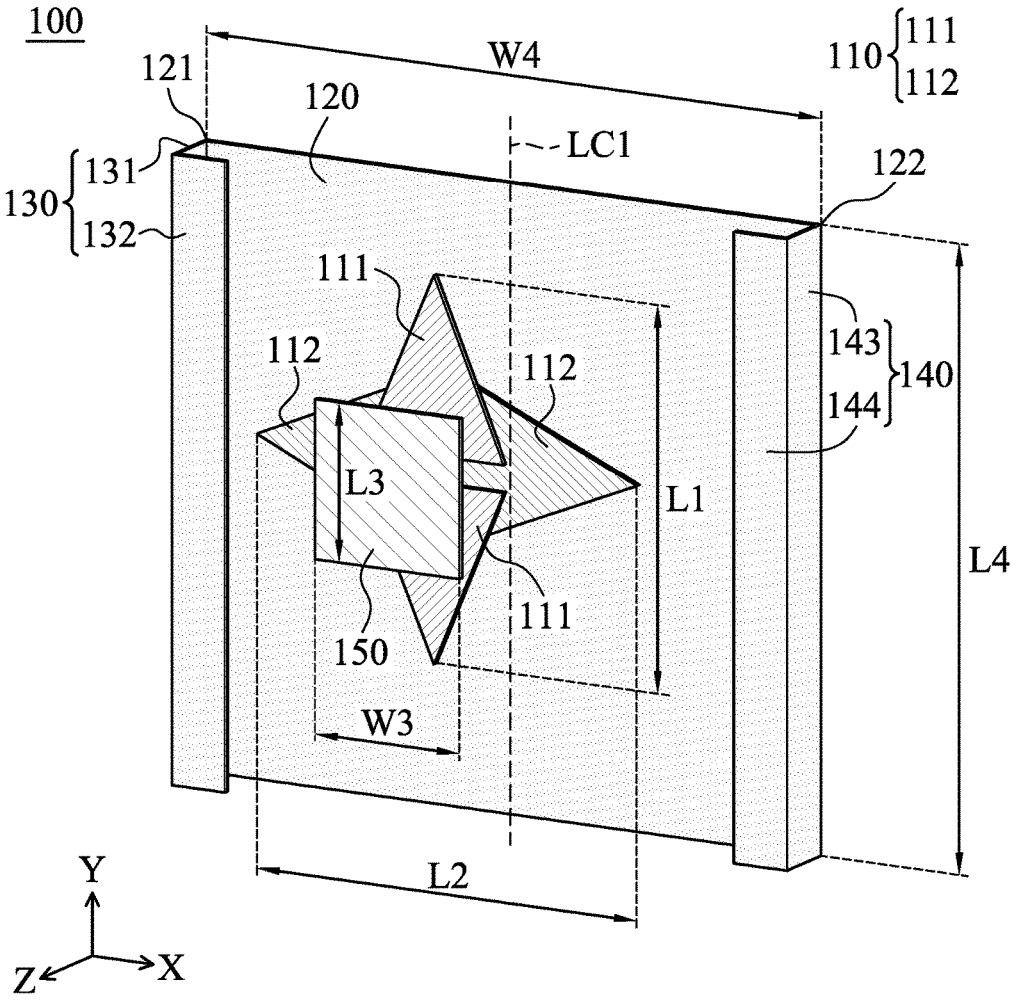
FIG. 1A is a perspective view of an antenna system according to an embodiment of the invention.
Figure 1B:
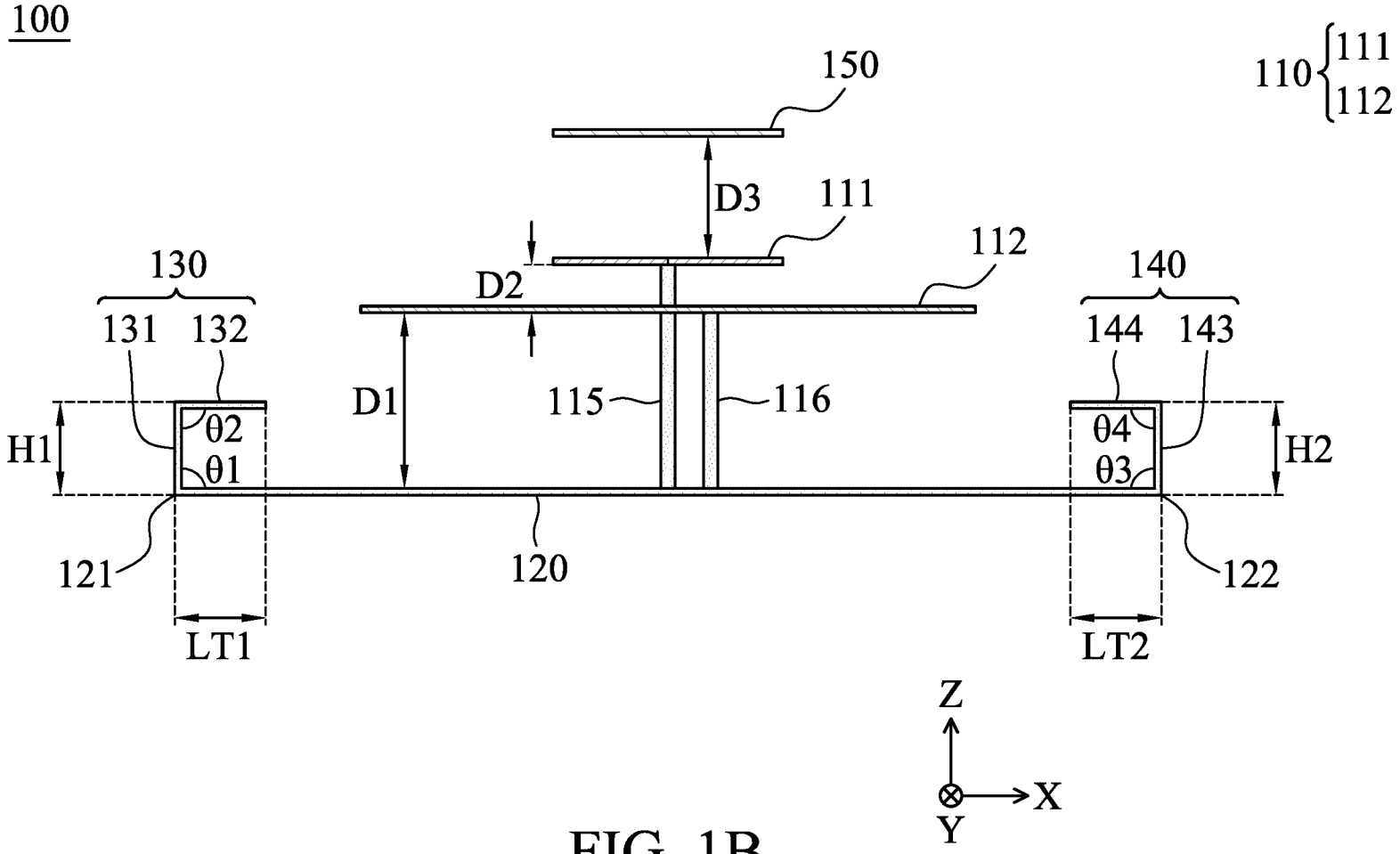
FIG. 1B is a side view of an antenna system according to an embodiment of the invention.

FIG. 1A is a perspective view of an antenna system 100 according to an embodiment of the invention. FIG. 1B is a side view of the antenna system 100 according to an embodiment of the invention. Please refer to FIG. 1A and FIG. 1B together. The antenna system 100 can be applied in a wireless access point. In the embodiments of FIG. 1A and FIG. 1B, the antenna system 100 at least includes a first dual-polarized antenna 110, a metal reflection plate 120, a first metal bending structure 130, and a second metal bending structure 140. It should be noted that the antenna system 100 may further include other components, such as a non-conductive antenna cover, a power supply module, and an RF (Radio Frequency) module although they are not displayed in FIG. 1A and FIG. 1B.

The first dual-polarized antenna 110 includes a first diamond-shaped dipole antenna element 111 and a second diamond-shaped dipole antenna element 112. The first diamond-shaped dipole antenna element 111 may be coupled through a first coaxial cable 115 to a signal source (not shown), and the second diamond-shaped dipole antenna element 112 may be coupled through a second coaxial cable 116 to the aforementioned signal source. The first diamond-shaped dipole antenna element 111 and the second diamond-shaped dipole antenna element 112 may be spaced apart from each other (with a distance of D2 therebetween) and perpendicular to each other, so as to exhibit dual-polarized characteristics. For example, if the first diamond-shaped dipole antenna element 111 has a first polarization direction and the second diamond-shaped dipole antenna element 112 has a second polarization direction, the first polarization direction may be perpendicular to the second polarization direction. Specifically, each of the first diamond-shaped dipole antenna element 111 and the second diamond-shaped dipole antenna element 112 includes a positive radiation arm and a negative radiation arm. Each of the positive radiation arm and the negative radiation arm may substantially have an isosceles triangular shape. The diamond-shape of each antenna element of the first dual-polarized antenna 110 is used to increase the operation bandwidth of the antenna system 100.

The metal reflection plate 120 is configured to reflect the radiation energy from the first dual-polarized antenna 110. Specifically, the metal reflection plate 120 has a first edge 121 and a second edge 122. The first edge 121 and the second edge 122 are opposite to each other, and are parallel to each other. The first diamond-shaped dipole antenna element 111 may be substantially parallel to the first edge 121 and the second edge 122 of the metal reflection plate 120. The second diamond-shaped dipole antenna element 112 may be substantially perpendicular to the first edge 121 and the second edge 122 of the metal reflection plate 120.

The first metal bending structure 130 includes a first planar portion 131 and a second planar portion 132. The second planar portion 132 is coupled through the first planar portion 131 to the first edge 121 of the metal reflection plate 120. The first planar portion 131 and the second planar portion 132 of the first metal bending structure 130 are not parallel to each other. The second metal bending structure 140 includes a third planar portion 143 and a fourth planar portion 144. The fourth planar portion 144 is coupled through the third planar portion 143 to the second edge 122 of the metal reflection plate 120. The third planar portion 143 and the fourth planar portion 144 of the second metal bending structure 140 are not parallel to each other. There is a central line LC1 positioned between the first edge 121 and the second edge 122 of the metal reflection plate 120. The first diamond-shaped dipole antenna element 111 of the first dual-polarized antenna 110 may be aligned with the central line LC1. The second planar portion 132 of the first metal bending structure 130 and the fourth planar portion 144 of the second metal bending structure 140 may both extend toward the central line LC1.

In some embodiments, the antenna system 100 further includes a first metal piece 150. The first metal piece 150 may substantially have a square shape, a rectangular shape, a circular shape, an elliptical shape, or any other shape. The first metal piece 150 is floating, and is completely separated from the first dual-polarized antenna 110. The first dual-polarized antenna 110 is positioned between the first metal piece 150 and the metal reflection plate 120. The first metal piece 150 can partially reflect and partially pass electromagnetic waves from the first dual-polarized antenna 110. According to practical measurements, the existence of a first metal piece 150 helps to increase the antenna gain of the first dual-polarized antenna 110. It should be noted that the first metal piece 150 is not an essential component of the antenna system 100, and the first metal piece 150 is omitted in other embodiments.

Figure 2:
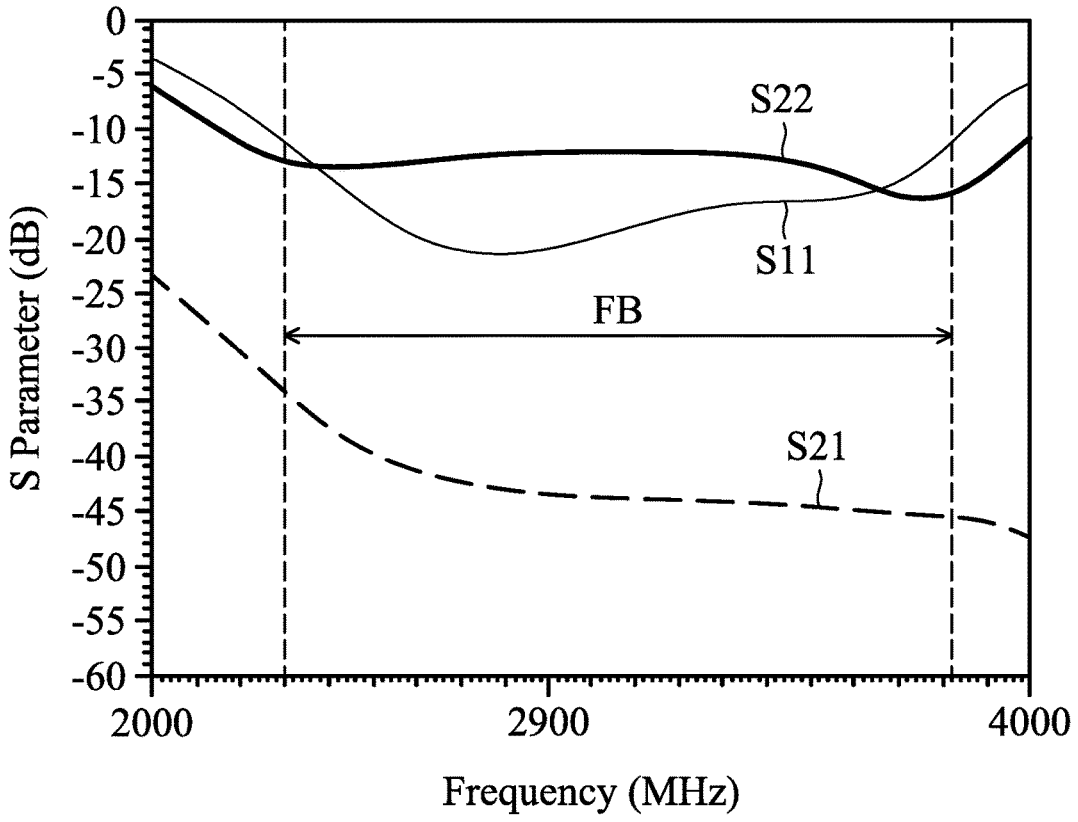
FIG. 2 is a diagram of S parameters of an antenna system according to an embodiment of the invention.

FIG. 2 is a diagram of S parameters of the antenna system 100 according to an embodiment of the invention. The horizontal axis represents the operation frequency (MHz), and the vertical axis represents the S parameters (dB). In the embodiment of FIG. 2, a feeding point of the first diamond-shaped dipole antenna element 111 is set as a first port (Port 1), and a feeding point of the second diamond-shaped dipole antenna element 112 is set as a second port (Port 2). According to the return loss characteristics (i.e., the absolute values of the S11 and S22 parameters) of FIG. 2, the first diamond-shaped dipole antenna element 111 and the second diamond-shaped dipole antenna element 112 of the antenna system 100 can at least cover an operation frequency band FB from 2300 MHz to 3800 MHz. Therefore, the antenna system 100 of the invention can at least support the multi-band and wideband operations of LTE (Long Term Evolution) Band 40/Band 41/Band 42/Band 43. Furthermore, the multi-polarized characteristics of the antenna system 100 help to solve the problem of multipath fading in indoor environments. On the other hand, according to the S21 (or S12) parameter of FIG. 2, within the aforementioned operation frequency band FB, the isolation (i.e., the absolute value of the S21 parameter) between the first diamond-shaped dipole antenna element 111 and the second diamond-shaped dipole antenna element 112 is at least 33.9 dB, and it can meet the requirements of practical application of general MIMO (Multi-Input and Multi-Output) antenna systems.

A general antenna system (without the first metal bending structure 130 and the second metal bending structure 140) often faces the problem of a vertically-polarized antenna having too large a beam width over a horizontal sectional plane but a horizontally-polarized antenna having too small a beam width over the horizontal sectional plane. This causes the vertically-polarized antenna and the horizontally-polarized antenna to have mismatch radiation beam widths over the horizontal sectional plane. For example, if the first metal bending structure 130 and the second metal bending structure 140 were removed from the antenna system 100, the operation characteristics of the antenna system 100 would be as indicated in Table I.

TABLE I

| Beam Width of Antenna System (Without Metal Bending Structure) | | |
|---|---|---|
| Frequency Point | 3 dB Beam Width of First Diamond-shaped Dipole Antenna Element 111 | 3 dB Beam Width of Second Diamond-shaped Dipole Antenna Element 112 |
| 2300 MHz | 82 degrees | 61 degrees |
| 2400 MHz | 81 degrees | 60 degrees |
| 2496 MHz | 80 degrees | 60 degrees |
| 2690 MHz | 80 degrees | 59 degrees |
| 3400 MHz | 81 degrees | 52 degrees |
| 3600 MHz | 71 degrees | 47 degrees |
| 3800 MHz | 59 degrees | 42 degrees |

In the invention, the first metal bending structure 130 and the second metal bending structure 140 are configured to equalize the beam width of the first diamond-shaped dipole antenna element 111 (e.g., the vertically-polarized antenna, but not limited thereto) and the beam width of the second diamond-shaped dipole antenna element 112 (e.g., the horizontally-polarized antenna, but not limited thereto). The operation characteristics of the antenna system 100 including the first metal bending structure 130 and the second metal bending structure 140 are as indicated in Table II.

TABLE II

| Beam Width of Antenna System (With Metal Bending Structure) | | |
|---|---|---|
| Frequency Point | 3 dB Beam Width of First Diamond-shaped Dipole Antenna Element 111 | 3 dB Beam Width of Second Diamond-shaped Dipole Antenna Element 112 |
| 2300 MHz | 75 degrees | 63 degrees |
| 2400 MHz | 73 degrees | 62 degrees |
| 2496 MHz | 71 degrees | 60 degrees |
| 2690 MHz | 69 degrees | 57 degrees |
| 3400 MHz | 68 degrees | 52 degrees |
| 3600 MHz | 62 degrees | 50 degrees |
| 3800 MHz | 53 degrees | 50 degrees |

By comparing Table I with Table II, the first metal bending structure 130 and the second metal bending structure 140 are configured to decrease the beam width of the first diamond-shaped dipole antenna element 111 and to increase the beam width of the second diamond-shaped dipole antenna element 112. For example, at the frequency point of 3800 MHz, the beam width of the first diamond-shaped dipole antenna element 111 may be decreased from original 59 degrees to 53 degrees, and the beam width of the second diamond-shaped dipole antenna element 112 may be increased from original 42 degrees to 50 degrees, such that their difference is significantly reduced. Accordingly, the beam width of the first diamond-shaped dipole antenna element 111 and the beam width of the second diamond-shaped dipole antenna element 112 are equalized by adding the first metal bending structure 130 and the second metal bending structure 140 to the first edge 121 and the second edge 122 of the metal reflection plate 120. With such a design, the first diamond-shaped dipole antenna element 111 and the second diamond-shaped dipole antenna element 112 of the antenna system 100 tend to match with each other, thereby improving the radiation performance of the antenna system 100 used as a beam switching antenna assembly.

Figure 3A:
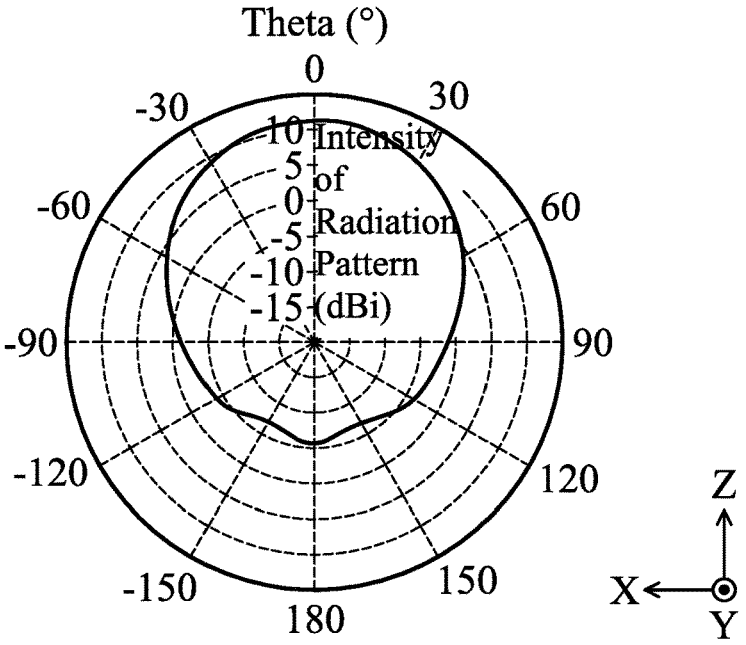
FIG. 3A is a radiation pattern of a first diamond-shaped dipole antenna element along a plane according to an embodiment of the invention.
Figure 3B:
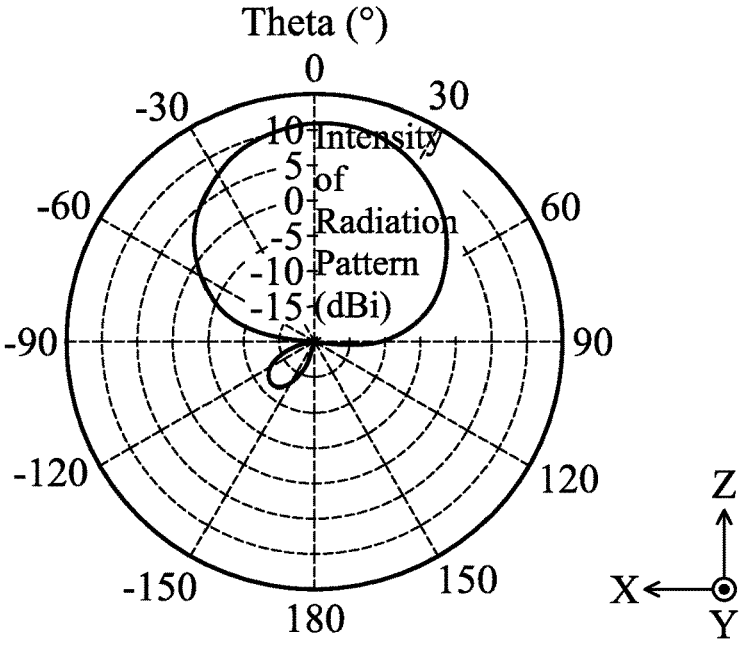
FIG. 3B is a radiation pattern of a second diamond-shaped dipole antenna element along a plane according to an embodiment of the invention.

FIG. 3A is a radiation pattern of the first diamond-shaped dipole antenna element 111 along the XZ plane according to an embodiment of the invention. FIG. 3B is a radiation pattern of the second diamond-shaped dipole antenna element 112 along the XZ plane according to an embodiment of the invention. FIG. 3A and FIG. 3B are measured at the frequency point of 2300 MHz. As shown in FIG. 3A and FIG. 3B, after the first metal bending structure 130 and the second metal bending structure 140 are added, the first diamond-shaped dipole antenna element 111 and the second diamond-shaped dipole antenna element 112 can have very similar beam widths.

Figure 4A:
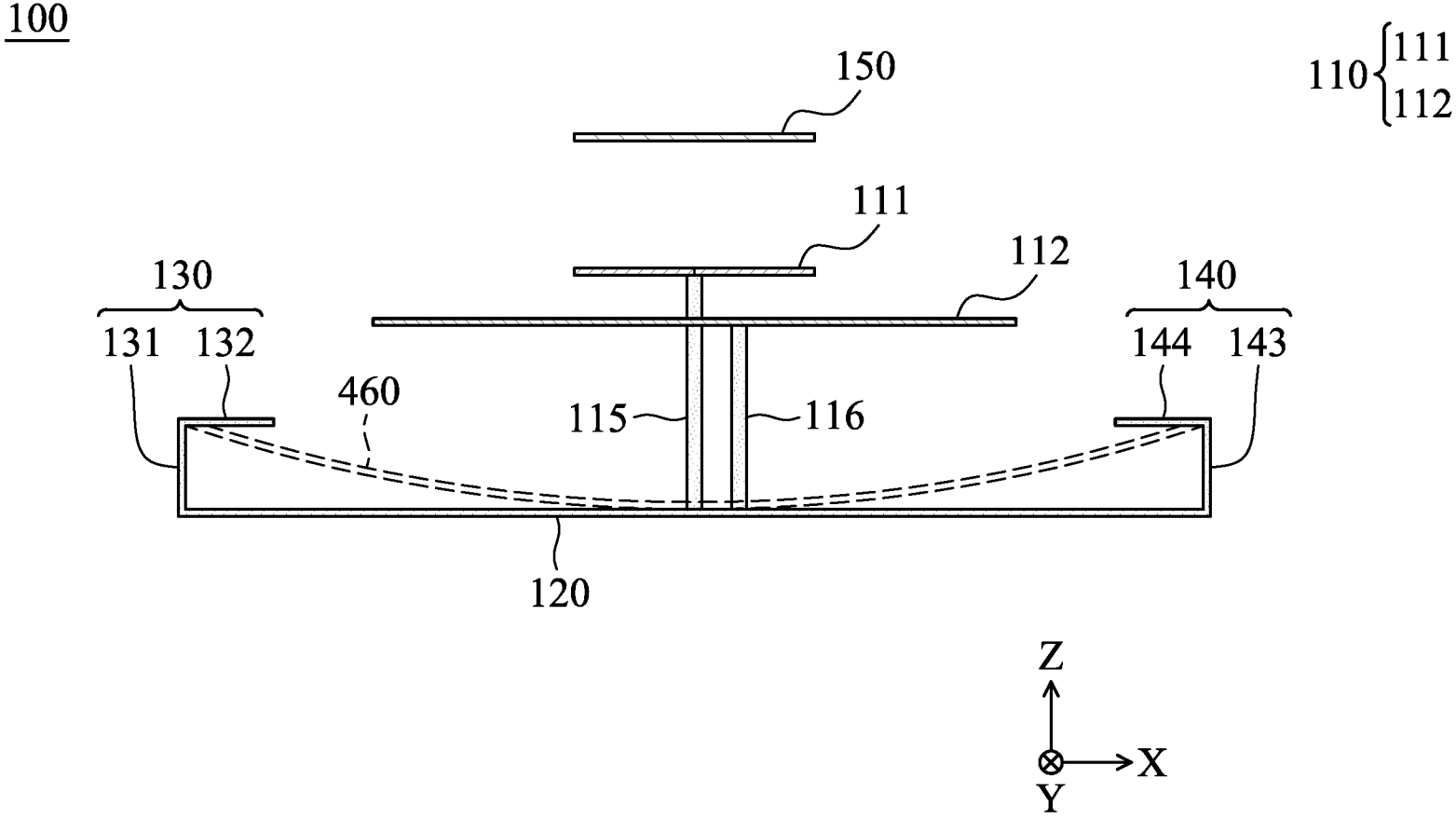
FIG. 4A is an equivalent circuit diagram of a metal reflection plate having a first metal bending structure and a second metal bending structure, used for a first diamond-shaped dipole antenna element, according to an embodiment of the invention.

FIG. 4A is an equivalent circuit diagram of the metal reflection plate 120 having the first metal bending structure 130 and the second metal bending structure 140, used for the first diamond-shaped dipole antenna element 111, according to an embodiment of the invention. With respect to the first diamond-shaped dipole antenna element 111, the metal reflection plate 120 having the first metal bending structure 130 and the second metal bending structure 140 is equivalent to a parabolic reflector 460. In comparison to the original planar metal reflection plate 120, the parabolic reflector 460 helps to decrease the beam width of the first diamond-shaped dipole antenna element 111 and to enhance the antenna gain of the first diamond-shaped dipole antenna element 111.

Figure 4B:
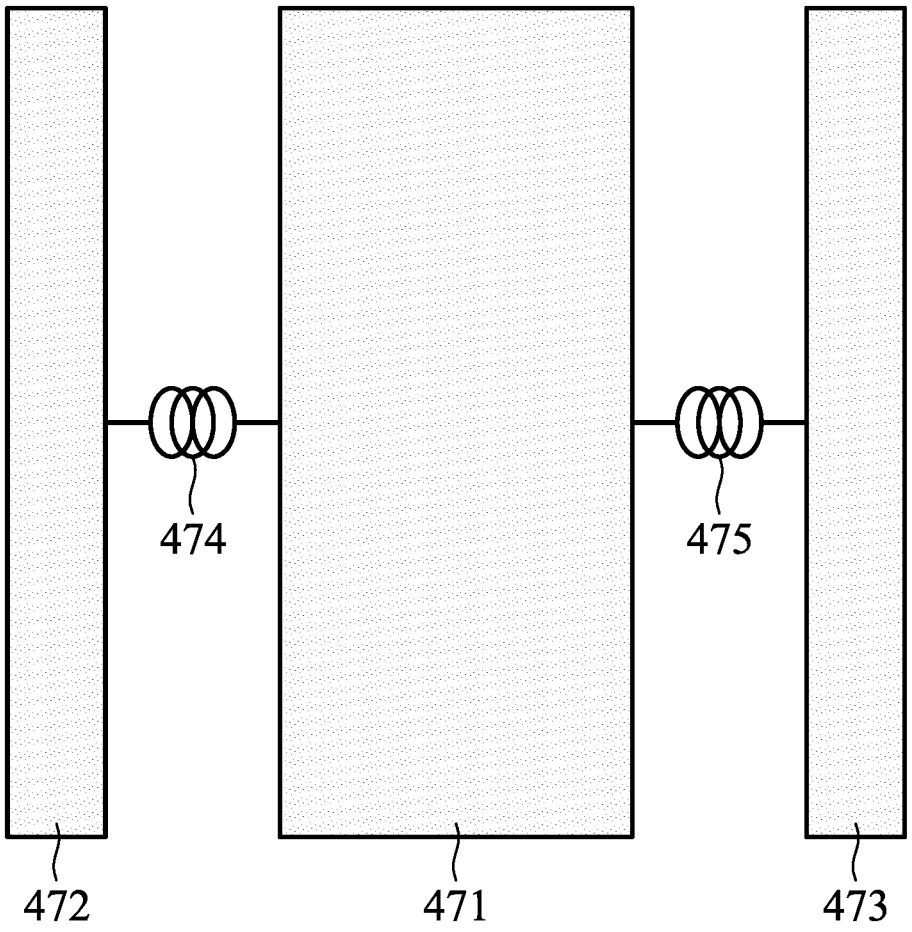
FIG. 4B is an equivalent circuit diagram of a metal reflection plate having a first metal bending structure and a second metal bending structure, used for a second diamond-shaped dipole antenna element, according to an embodiment of the invention.

FIG. 4B is an equivalent circuit diagram of the metal reflection plate 120 having the first metal bending structure 130 and the second metal bending structure 140, used for the second diamond-shaped dipole antenna element 112, according to an embodiment of the invention. With respect to the second diamond-shaped dipole antenna element 112, the metal reflection plate 120 having the first metal bending structure 130 and the second metal bending structure 140 is equivalent to a compound reflector 470. The compound reflector 470 includes a central portion 471, a first side portion 472, a second side portion 473, a first effective inductor 474, and a second effective inductor 475. The first effective inductor 474 is coupled between the central portion 471 and the first side portion 472. The second effective inductor 475 is coupled between the central portion 471 and the second side portion 473. When the operation frequency of the antenna system 100 becomes lower, each of the first effective inductor 474 and the second effective inductor 475 is similar to a short-circuited path, such that the total reflection area of the compound reflector 470 (i.e., the total area of the central portion 471, the first side portion 472, and the second side portion 473) becomes larger. Conversely, when the operation frequency of the antenna system 100 becomes higher, each of the first effective inductor 474 and the second effective inductor 475 is similar to an open-circuited path, such that the total reflection area of the compound reflector 470 (i.e., only the area of the central portion 471) becomes smaller. In comparison to the original planar metal reflection plate 120, the compound reflector 470 helps to increase the beam width of the second diamond-shaped dipole antenna element 112, especially for high-frequency points (e.g., 3600 MHz or the higher frequency).

Please refer to FIG. 1A and FIG. 1B again. In some embodiments, the element sizes of the antenna system 100 are as follows. The length L1 of the first diamond-shaped dipole antenna element 111 is substantially equal to 0.5 wavelength ($\lambda/2$) of a central frequency of the operation frequency band FB. The length L2 of the second diamond-shaped dipole antenna element 112 is substantially equal to 0.5 wavelength ($\lambda/2$) of the central frequency of the operation frequency band FB. The distance D1 between the first dual-polarized antenna 110 (or the second diamond-shaped dipole antenna element 112) and the metal reflection plate 120 is equal to 0.25 wavelength ($\lambda/4$) of the central frequency of the operation frequency band FB. In this embodiment, the distance D2 between the first diamond-shaped dipole antenna element 111 and the second diamond-shaped dipole antenna element 112 is from 3 mm to 7 mm, such as 5 mm. The length L3 or the width W3 of the first metal piece 150 is from 0.25 to 0.5 wavelength (λ/4 to λ/2) of the central frequency of the operation frequency band FB. The distance D3 between the first dual-polarized antenna 110 (or the first diamond-shaped dipole antenna element 111) and the first metal piece 150 is from 10 mm to 20 mm, such as 15 mm. The length L4 of the metal reflection plate 120 is from 60 mm to 100 mm, such as 80 mm. The length W4 of the metal reflection plate 120 is from 100 mm to 120 mm, such as 110 mm. In other embodiments, the distances D2 and D3 are adjustable according to the central frequency of each diamond-shaped dipole antenna element.

Specifically, the element sizes of the first metal bending structure 130 and the second metal bending structure 140 are as follows. A first angle θ1 is formed between the first planar portion 131 of the first metal bending structure 130 and the metal reflection plate 120. A second angle θ2 is formed between the second planar portion 132 and the first planar portion 131 of the first metal bending structure 130. A third angle θ3 is formed between the third planar portion 143 of the second metal bending structure 140 and the metal reflection plate 120. A fourth angle θ4 is formed between the fourth planar portion 144 and the third planar portion 143 of the second metal bending structure 140. In order to achieve the desired inductance, the sum of the first angle θ1 and the second angle θ2 should be smaller than 270 degrees, and the sum of the third angle θ3 and the fourth angle θ4 should be also smaller than 270 degrees. In some embodiments, the first angle θ1, the second angle θ2, the third angle θ3, and the fourth angle θ4 are all equal to 90 degrees, such that the second planar portion 132 of the first metal bending structure 130 is parallel to the metal reflection plate 120, and the fourth planar portion 144 of the second metal bending structure 140 is also parallel to the metal reflection plate 120. If the first metal bending structure 130 and the second metal bending structure 140 are symmetrical with respect to the central line LC1, the third angle θ3 will be exactly equal to the first angle θ1, and the fourth angle θ4 will be exactly equal to the second angle θ2. In alternative embodiments, the first metal bending structure 130 and the second metal bending structure 140 are not symmetrical. Thus, the third angle θ3 may be different from the first angle θ1, and the fourth angle θ4 may be different from the second angle θ2.

The first metal bending structure 130 has a first vertical projection on the plane on which the metal reflection plate 120 is located. The second metal bending structure 140 has a second vertical projection on the plane on which the metal reflection plate 120 is located. The length LT1 of the first vertical projection and the length LT2 of the second vertical projection should be both shorter than 0.25 wavelength (λ/4) of the central frequency of the operation frequency band FB. The so-called "length" means the longest distance between two points selected from each vertical projection. For example, the lengths LT1 and LT2 may be both from 5 mm to 15 mm, such as 10 mm. According to microwave circuit theory, the metal reflection plate 120 having the first metal bending structure 130 is equivalent to a transmission line with a short-circuited terminal, so as to form the aforementioned first effective inductor 474, and the metal reflection plate 120 having the second metal bending structure 140 is equivalent to another transmission line with another short-circuited terminal, so as to form the aforementioned second effective inductor 475. Generally, if the length LT1 of the first vertical projection of the first metal bending structure 130 becomes longer and the length LT2 of the second vertical projection of the second metal bending structure 140 becomes longer, the inductance of the first effective inductor 474 and the inductance of the second effective inductor 475 will both become larger. Conversely, if the length LT1 of the first vertical projection of the first metal bending structure 130 becomes shorter and the length LT2 of the second vertical projection of the second metal bending structure 140 becomes shorter, the inductance of the first effective inductor 474 and the inductance of the second effective inductor 475 will both becomes smaller.

The height H1 of the first metal bending structure 130 on the metal reflection plate 120, and the height H2 of the second metal bending structure 140 on the metal reflection plate 120 are both shorter than 0.5 wavelength (λ/2) of the highest frequency of the operation frequency band FB. The so-called "height" means the longest distance between the metal reflection plate 120 and one point selected from each metal bending structure. For example, the heights H1 and H2 may be both from 5 mm to 15 mm, such as 10 mm. According to microwave circuit theory, the metal reflection plate 120 having the first metal bending structure 130 is equivalent to a parallel-plate waveguide, and the metal reflection plate 120 having the second metal bending structure 140 is equivalent to another parallel-plate waveguide. Only TEM (Transverse Electric and Magnetic) mode electromagnetic waves can be transmitted in these parallel-plate waveguides; however, neither TE (Transverse Electric) mode electromagnetic waves nor TM (Transverse Magnetic) mode electromagnetic waves can be transmitted in these parallel-plate waveguides. Generally, if the height H1 of the first metal bending structure 130 becomes longer and the height H2 of the second metal bending structure 140 becomes longer, the inductance of the first effective inductor 474 and the inductance of the second effective inductor 475 will both become larger. Conversely, if the height H1 of the first metal bending structure 130 becomes shorter and the height H2 of the second metal bending structure 140 becomes shorter, the inductance of the first effective inductor 474 and the inductance of the second effective inductor 475 will both become smaller.

The above element sizes are obtained according to many experiment results, and they can optimize the beam width, the operation frequency band, and the impedance matching of the antenna system 100.

Figure 5:
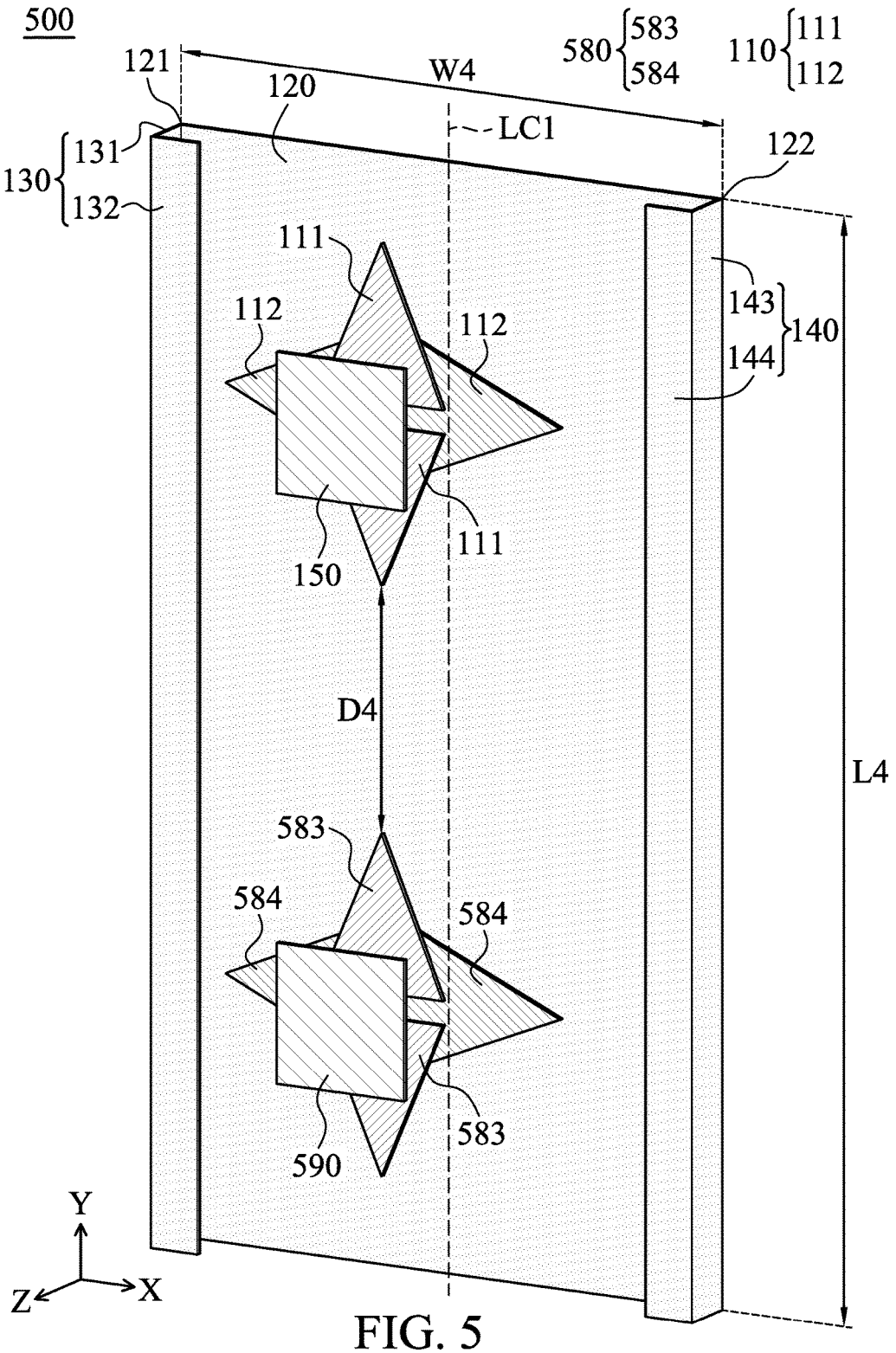
FIG. 5 is a perspective view of an antenna system according to another embodiment of the invention.
Figure 6A:
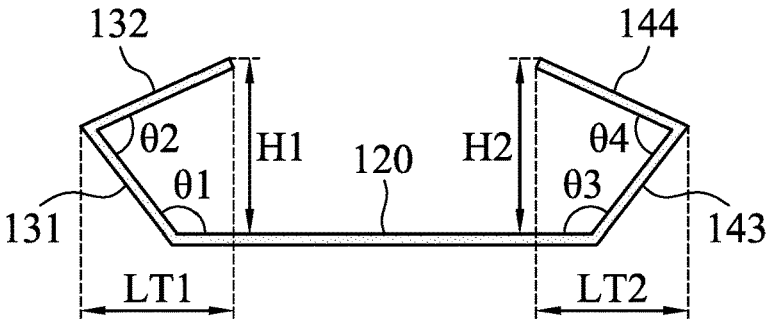
FIGS. 6A to 6I are side views of a metal reflection plate having a first metal bending structure and a second metal bending structure according to some embodiments of the invention.
Figure 6B:
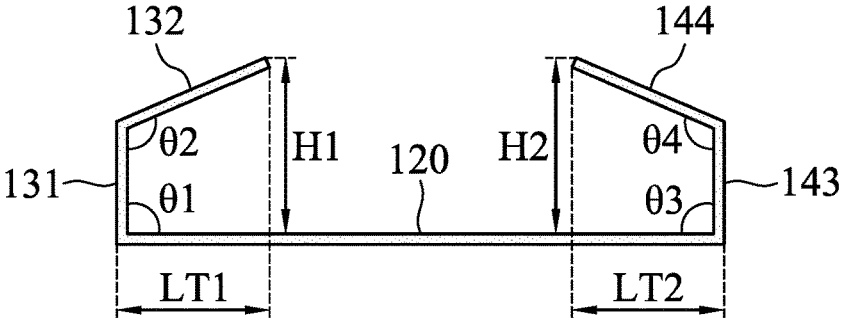
Figure 6C:
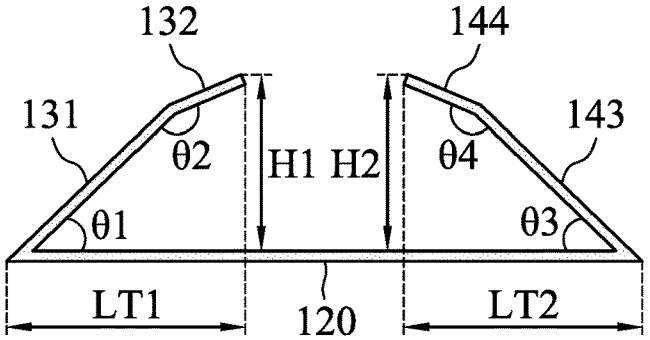
Figure 6D:
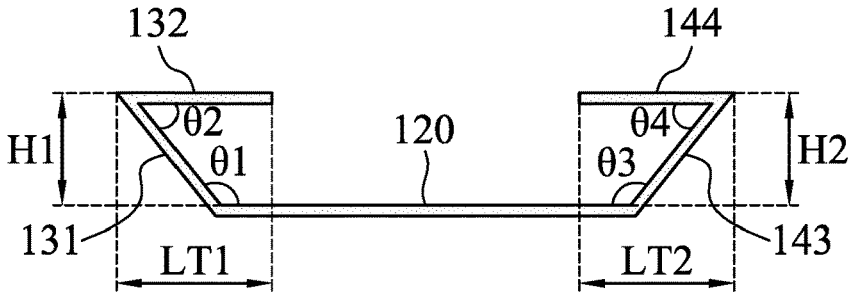
Figure 6E:
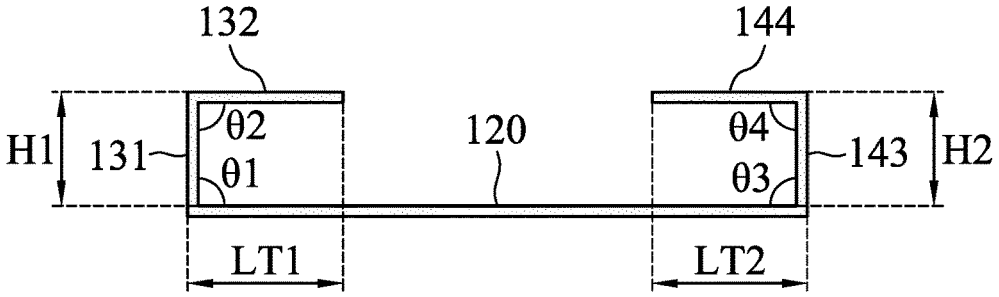
Figure 6F:
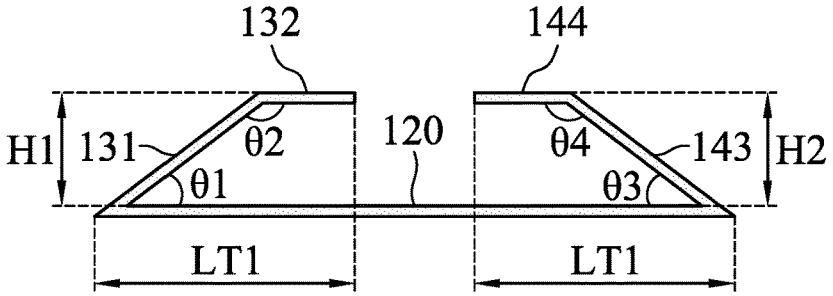
Figure 6G:
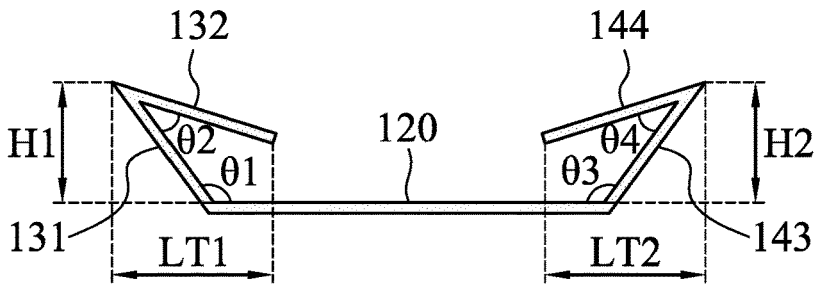
Figure 6H:
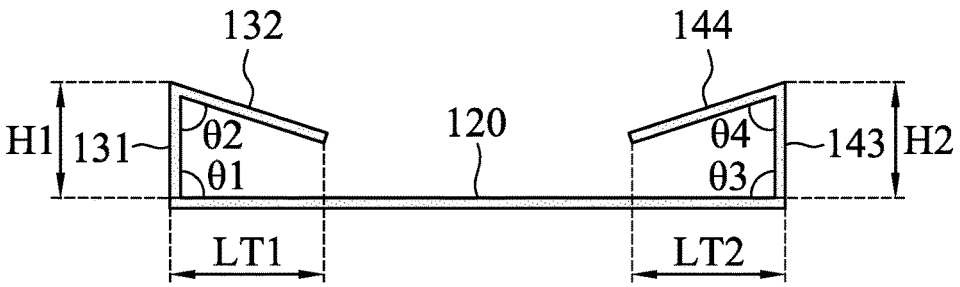
Figure 6I:
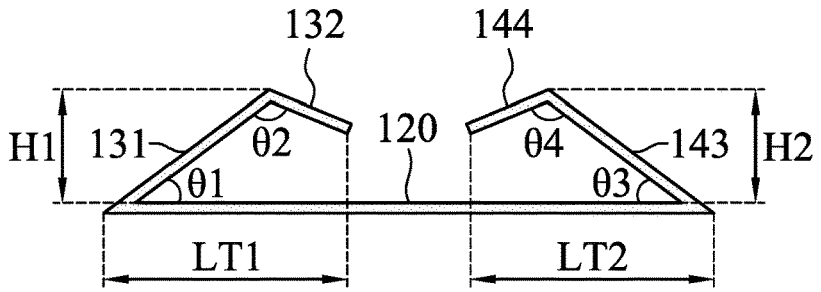

FIG. 5 is a perspective view of an antenna system 500 according to another embodiment of the invention. In the embodiment of FIG. 5, the antenna system 500 further includes a second dual-polarized antenna 580 and/or a second metal piece 590. Furthermore, adjustments are made so that the length L4 of the metal reflection plate 120 is from 180 mm to 220 mm, such as 200 mm, in order to be consistent with the second dual-polarized antenna 580. The second dual-polarized antenna 580 includes a third diamond-shaped dipole antenna element 583 and a fourth diamond-shaped dipole antenna element 584. The third diamond-shaped dipole antenna element 583 and the fourth diamond-shaped dipole antenna element 584 may be spaced apart from each other and perpendicular to each other. For example, the third diamond-shaped dipole antenna element 583 may be substantially parallel to the first edge 121 and the second edge 122 of the metal reflection plate 120 (used as a vertically-polarized antenna); the fourth diamond-shaped dipole antenna element 584 may be substantially perpendicular to the first edge 121 and the second edge 122 of the metal reflection plate 120 (used as a horizontally-polarized antenna). The second metal piece 590 is floating, and is completely separated from the second dual-polarized antenna 580. The second dual-polarized antenna 580 is positioned between the second metal piece 590 and the metal reflection plate 120. The structures and sizes of the second dual-polarized antenna 580 and second metal piece 590 are substantially the same as those of the aforementioned first dual-polarized antenna 110 and first metal piece 150. The second dual-polarized antenna 580 is adjacent to the first dual-polarized antenna 110. For example, the distance D4 between the second dual-polarized antenna 580 and the first dual-polarized antenna 110 may be from 50 mm to 60 mm, such as 56.5 mm. In some embodiments, the first dual-polarized antenna 110 and the second dual-polarized antenna 580 are both enabled to form a 2×2 MIMO array antenna system, where the first diamond-shaped dipole antenna element 111 and the third diamond-shaped dipole antenna element 583 are controlled together, and the second diamond-shaped dipole antenna element 112 and the fourth diamond-shaped dipole antenna element 584 are additionally controlled together. In alternative embodiments, the first dual-polarized antenna 110 and the second dual-polarized antenna 580 are both enabled to form a 4×4 MIMO array antenna system, where the first diamond-shaped dipole antenna element 111, the second diamond-shaped dipole antenna element 112, the third diamond-shaped dipole antenna element 583, and the fourth diamond-shaped dipole antenna element 584 are controlled independently. When a plurality of antenna systems 500 are used and arranged in a ring shape or a semi-ring shape, a beam switching antenna assembly can be formed. The beam switching antenna assembly can selectively use any one antenna system 500, or selectively use a combination of any adjacent two antenna systems 500, so as to perform signal transmission and reception. For example, when reception signals come from a variety of directions, the beam switching antenna assembly can enable only one antenna system 500 toward the direction of maximum signal strength, and disable the other antenna systems 500. Alternatively, according to the direction of signal strength, two adjacent antenna systems 500 can be enabled together, so as to form a combined beam. It should be understood that the antenna system 500 may include more or fewer dual-polarized antennas, such as 1, 3, 4, 5 or 6 dual-polarized antennas, although there are exactly two dual-polarized antennas displayed in FIG. 5.

FIGS. 6A to 6I are side views of the metal reflection plate 120 having the first metal bending structure 130 and the second metal bending structure 140 according to some embodiments of the invention. The definitions of the aforementioned lengths LT1 and LT2 and the aforementioned heights H1 and H2 can be easily understood by observing FIGS. 6A to 6I. According to practical measurements, the different structures of FIGS. 6A to 6I all help to equalize the beam width of each vertically-polarized antenna and the beam width of each horizontally-polarized antenna in the antenna system.

Figure 7A:
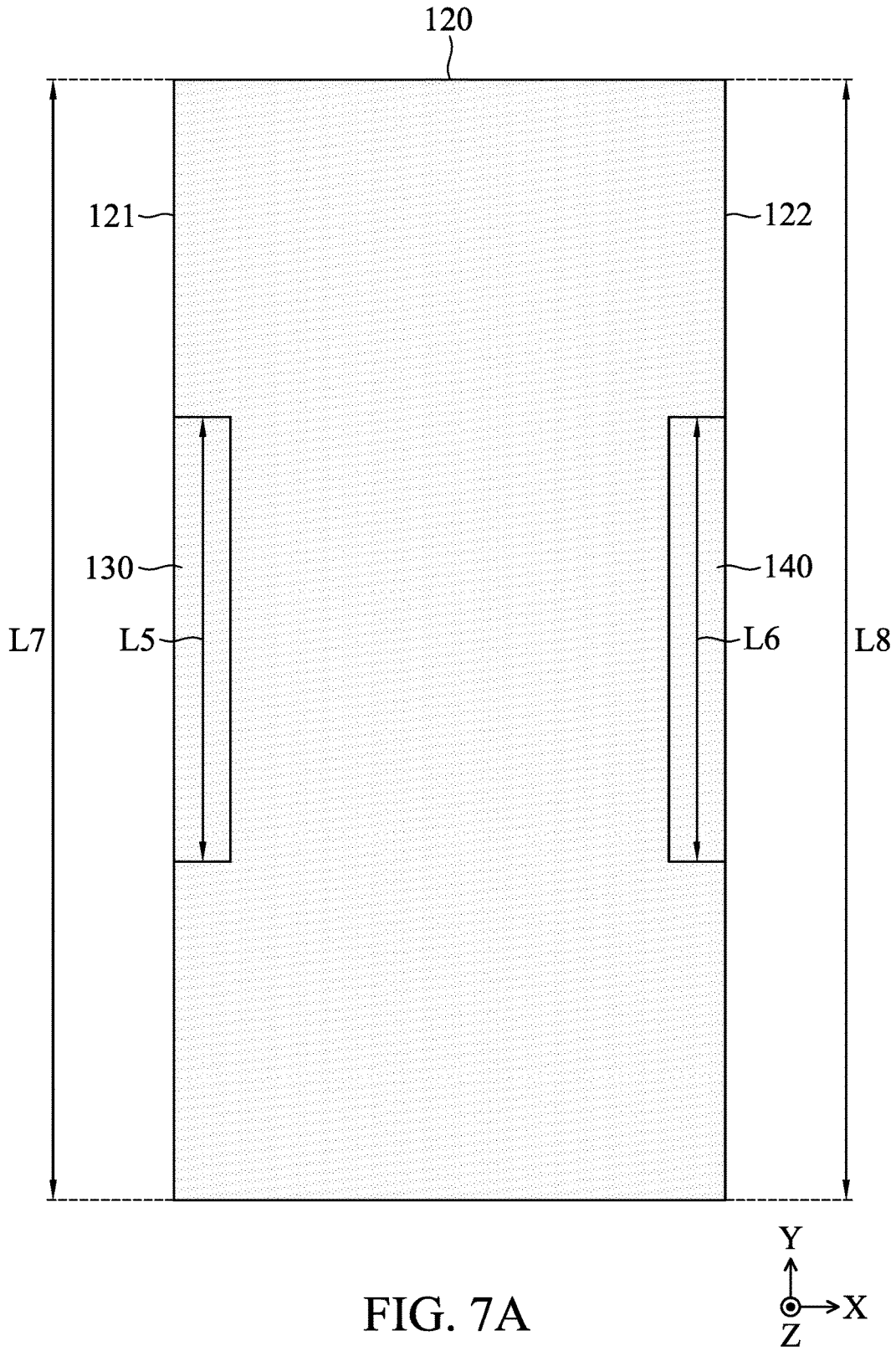
FIG. 7A is a top view of a metal reflection plate having a first metal bending structure and a second metal bending structure according to an embodiment of the invention.
Figure 7B:
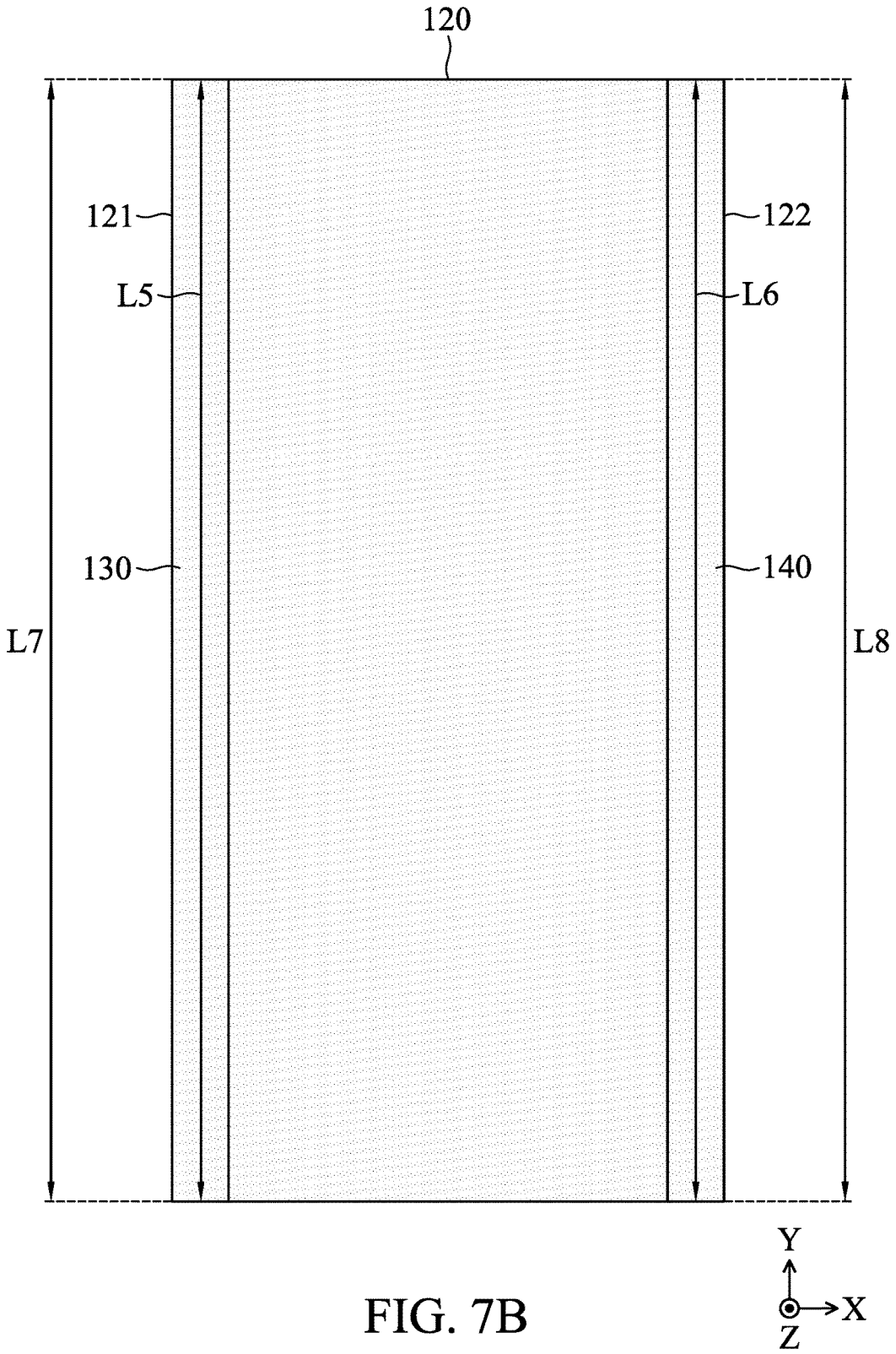
FIG. 7B is a top view of a metal reflection plate having a first metal bending structure and a second metal bending structure according to another embodiment of the invention.

FIG. 7A is a top view of the metal reflection plate 120 having the first metal bending structure 130 and the second metal bending structure 140 according to an embodiment of the invention. In the embodiment of FIG. 7A, the length L5 of the first metal bending structure 130 is shorter than the length L7 of the first edge 121 of the metal reflection plate 120, and the length L6 of the second metal bending structure 140 is shorter than the length L8 of the second edge 122 of the metal reflection plate 120. That is, each metal bending structure covers only a portion of the corresponding edge of the metal reflection plate 120. FIG. 7B is a top view of the metal reflection plate 120 having the first metal bending structure 130 and the second metal bending structure 140 according to another embodiment of the invention. In the embodiment of FIG. 7B, the length L5 of the first metal bending structure 130 is exactly equal to the length L7 of the first edge 121 of the metal reflection plate 120, and the length L6 of the second metal bending structure 140 is exactly equal to the length L8 of the second edge 122 of the metal reflection plate 120. That is, each metal bending structure covers the whole corresponding edge of the metal reflection plate 120. According to practical measurements, the different structures of FIGS. 7A and 7B both help to equalize the beam width of each vertically-polarized antenna and the beam width of each horizontally-polarized antenna in the antenna system; however, FIG. 7B has better performance than FIG. 7A.

The invention proposes a novel antenna system. In comparison to the conventional design, the invention has at least the advantages of: (1) making the beam widths of different polarized antennas (e.g., a horizontally-polarized antenna and a vertically-polarized antenna) become almost the same, (2) increasing the isolation between the antennas, (3) covering wideband operations, and (4) enhancing the antenna gain of the antenna system. Therefore, the invention is suitable for application in a variety of indoor environments, so as to solve the problem of poor communication quality due to signal reflection and multipath fading in conventional design.

Note that the above element sizes, element parameters, element shapes, and frequency ranges are not limitations of the invention. An antenna designer can fine-tune these settings or values according to different requirements. It should be understood that the antenna system of the invention is not limited to the configurations of FIGS. 1-7. The invention may merely include any one or more features of any one or more embodiments of FIGS. 1-7. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a first dual-polarized antenna, comprising a first diamond-shaped dipole antenna element and a second diamond-shaped dipole antenna element;

a metal reflection plate, having a first edge and a second edge opposite to each other, wherein the metal reflection plate is configured to reflect radiation energy from the first dual-polarized antenna;

a first metal bending structure, comprising a first planar portion and a second planar portion, wherein the second planar portion is coupled through the first planar portion to the first edge of the metal reflection plate, and wherein the first planar portion and the second planar portion are not parallel to each other; and a second metal bending structure, comprising a third planar portion and a fourth planar portion, wherein the fourth planar portion is coupled through the third planar portion to the second edge of the metal reflection plate, and wherein the third planar portion and the fourth planar portion are not parallel to each other;

wherein a major axis of the first diamond-shaped dipole antenna element is parallel to the first edge and the second edge of the metal reflection plate, and wherein a major axis of the second diamond-shaped dipole antenna element is perpendicular to the first edge and the second edge of the metal reflection plate.

2. The antenna system as claimed in claim 1, wherein the first metal bending structure and the second metal bending structure are configured to decrease a beam width of the first diamond-shaped dipole antenna element and to increase a beam width of the second diamond-shaped dipole antenna element.

3. The antenna system as claimed in claim 1, wherein a length of the first metal bending structure is shorter than or equal to a length of the first edge of the metal reflection plate, and wherein a length of the second metal bending structure is shorter than or equal to a length of the second edge of the metal reflection plate.

4. The antenna system as claimed in claim 1, wherein the first diamond-shaped dipole antenna element and the second diamond-shaped dipole antenna element are spaced apart from each other, and are perpendicular to each other.

5. The antenna system as claimed in claim 1, wherein a central line is positioned between the first edge and the second edge of the metal reflection plate, and wherein the second planar portion of the first metal bending structure and the fourth planar portion of the second metal bending structure both extend toward the central line.

6. The antenna system as claimed in claim 1, wherein the antenna system covers an operation frequency band from 2300 MHz to 3800 MHz.

7. The antenna system as claimed in claim 6, wherein a distance between the first dual-polarized antenna and the metal reflection plate is equal to 0.25 wavelength of a central frequency of the operation frequency band.

8. The antenna system as claimed in claim 6, further comprising:

a first metal piece, separated from the first dual-polarized antenna, wherein the first dual-polarized antenna is positioned between the first metal piece and the metal reflection plate.

9. The antenna system as claimed in claim 8, wherein a length of the first metal piece is from 0.25 to 0.5 wavelength of a central frequency of the operation frequency band.

10. The antenna system as claimed in claim 6, wherein the first metal bending structure has a first vertical projection on a plane on which the metal reflection plate is located, wherein the second metal bending structure has a second vertical projection on the plane on which the metal reflection plate is located, and wherein a length of the first vertical projection and a length of the second vertical projection are both shorter than 0.25 wavelength of a central frequency of the operation frequency band.

11. The antenna system as claimed in claim 6, wherein a height of the first metal bending structure on the metal reflection plate, and a height of the second metal bending structure on the metal reflection plate are both shorter than 0.5 wavelength of the highest frequency of the operation frequency band.

12. The antenna system as claimed in claim 1, wherein a first angle is formed between the first planar portion of the first metal bending structure and the metal reflection plate, wherein a second angle is formed between the second planar portion and the first planar portion of the first metal bending structure, wherein a third angle is formed between the third planar portion of the second metal bending structure and the metal reflection plate, and wherein a fourth angle is formed between the fourth planar portion and the third planar portion of the second metal bending structure.

13. The antenna system as claimed in claim 12, wherein the third angle is equal to the first angle, and wherein the fourth angle is equal to the second angle.

14. The antenna system as claimed in claim 12, wherein a sum of the first angle and the second angle is smaller than 270 degrees, and wherein a sum of the third angle and the fourth angle is smaller than 270 degrees.

15. The antenna system as claimed in claim 12, wherein the first angle, the second angle, the third angle, and the fourth angle are all equal to 90 degrees.

16. The antenna system as claimed in claim 1, further comprising:

a second dual-polarized antenna, comprising a third diamond-shaped dipole antenna element and a fourth diamond-shaped dipole antenna element, wherein the second dual-polarized antenna is adjacent to the first dual-polarized antenna.

17. The antenna system as claimed in claim 16, further comprising:

a second metal piece, separated from the second dual-polarized antenna, wherein the second dual-polarized antenna is positioned between the second metal piece and the metal reflection plate.

18. The antenna system as claimed in claim 16, wherein the antenna system is a beam switching antenna assembly for selectively using the first dual-polarized antenna, the second dual-polarized antenna, or a combination thereof to perform signal reception and transmission.

* * * * *